United States Patent [19]

Loeffler

[11] 4,062,543

[45] Dec. 13, 1977

[54] HELICAL SPRING GAME

[76] Inventor: Ronald Loeffler, 2100A Evergreen Lane, Point Pleasant, N.J. 08742

[21] Appl. No.: 712,846

[22] Filed: Aug. 9, 1976

[51] Int. Cl.[2] ..... A63F 7/02; A63B 71/04

[52] U.S. Cl. ..... 273/110; 273/86 C; 273/112

[58] Field of Search ..... 273/108, 109, 118, 86 C, 273/110, 112; 46/43, 47, 32, 1 C

[56] References Cited

U.S. PATENT DOCUMENTS

| | | | |
|---|---|---|---|
| 2,208,952 | 7/1940 | Ward | 273/86 R |
| 2,596,688 | 5/1952 | Hinsen | 273/112 |
| 2,662,336 | 12/1953 | Zalkind | 46/36 |
| 2,877,597 | 3/1959 | Brant | 46/47 |
| 3,567,221 | 3/1971 | Stults | 273/1 R |
| 3,578,329 | 5/1971 | Biedny | 273/119 R |

FOREIGN PATENT DOCUMENTS

| | | | |
|---|---|---|---|
| 236,282 | 2/1910 | Germany | 273/86 C |

OTHER PUBLICATIONS

Affidavit of Paul E. Shapiro with accompanying photographs.

*Primary Examiner*—Richard C. Pinkham
*Assistant Examiner*—Lawrence E. Anderson
*Attorney, Agent, or Firm*—Carella, Bain, Gilfillan & Rhodes

[57] ABSTRACT

Entertainment apparatus providing a game and including a spring positioned normally vertically on a base, a plurality of travelling objects positioned slidably along the length of the spring between the top and bottom thereof and upon a player displacing the spring from its normally vertical position and releasing the spring, the spring vibrating and returning to its normal position and the vibrating spring causing the travelling objects to slide downwardly along the length of the spring from the top to the bottom thereof and the player first causing all of the travelling objects to reach the bottom of the spring being the winner of the game. The apparatus may further include a plurality of markers disposed on the base around the spring which markers define positions or directions toward which the players can displace the spring. Further, the entertainment apparatus may include mechanism for randomly selecting one of the plurality of markers toward which a player is to displace the spring.

1 Claim, 4 Drawing Figures

HELICAL SPRING GAME

BACKGROUND OF THE INVENTION

This invention relates generally to the field of entertainment apparatus and in particular this invention relates to entertainment apparatus providing a game to be played by one or more players. One of the continuing problems which faces the entertainment apparatus industry is that of designing entertainment apparatus which is of simple and durable construction and yet which is capable of providing entertainment to a player, such as a child. A further problem is that of providing a game which is both simple and yet entertaining such that the player, such as a child, will not tire of the game being played after it has been played a few times.

These problems are equally applicable to entertainment apparatus for adults and games designed for their pleasure.

As is understood by those skilled in the entertainment apparatus art, it is often the entertainment apparatus which is of simple structure, easy and simple to play, which is the most successful in the marketplace and which is played over and over again by the players thereby giving the entertainment apparatus great value in the marketplace.

SUMMARY OF THE INVENTION

It is the primary object of the present invention to provide entertainment apparatus which is of simple structure, easy to play and which is durable and easily manufactured and assembled.

It is a further object of the present invention to provide entertainment apparatus which can be played by one or more players.

It is a still further object of the present invention to provide entertainment apparatus which can be played by people of all age groups.

Yet another object of the present invention is to provide entertainment apparatus wherein the element of random chance may be or may not be utilized by the players without detracting from the object of the game.

These objects and others are achieved by the entertainment apparatus of the present invention which may include a spring positioned normally vertically on a base, a plurality of travelling means positioned slidably along the length of the spring between the top and bottom thereof and upon a player displacing the spring from its normally vertical position nd releasing the spring, the spring vibrating and returning to its normal position and the vibrating spring causes the travelling means to slide downwardly along the length of the spring from the top to the bottom thereof and the player first causing all of the travelling means to reach the bottom of the spring being the winner of the game. The entertainment apparatus may further include a plurality of markers disposed on the base around the springs which markers define positions or directions toward which the player can displace the spring. Further, the entertainment apparatus of the present invention may include means for randomly selecting one of the plurality of markers towards which a player is to displace the spring.

BRIEF DESCRIPTION OF THE DRAWINGS

A more complete understanding of the present invention may be had from the following detailed description, particularly when read in the light of the accompanying drawings wherein.

DETAILED DESCRIPTION OF THE INVENTION

Figure 1:
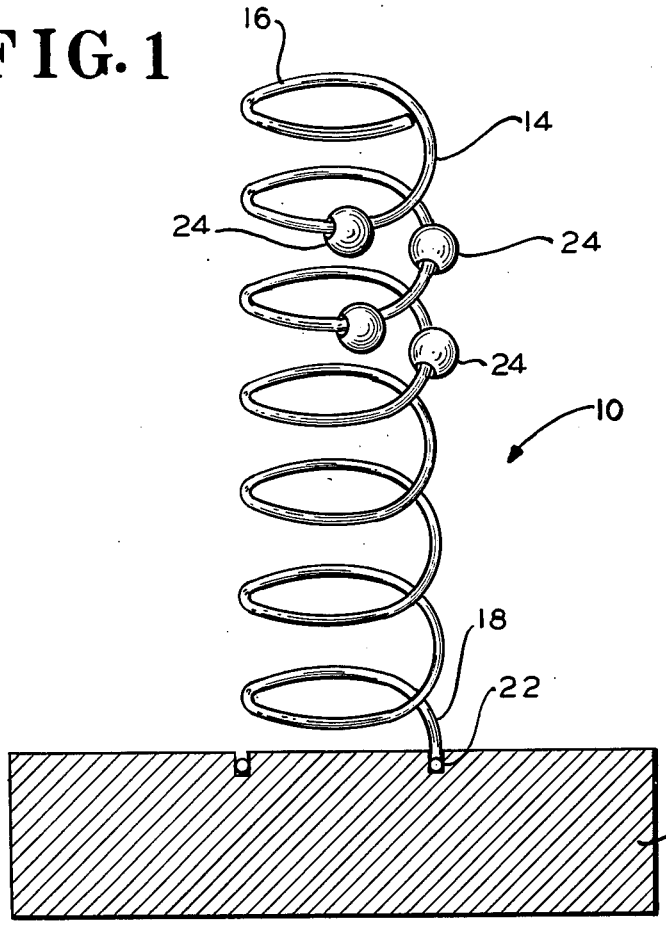
FIG. 1 is a diagrammatic side elevational view, in partial cross-section, of one embodiment of the entertainment apparatus according to the present invention.

Referring now to FIG. 1, there is illustrated diagrammatically an entertainment apparatus embodying the present invention and being designated generally by numerical designation 10. Such entertainment apparatus may include a base 10 and a generally helical spring 14 having a top end 16 and a bottom end 18 with the bottom end 18 being suitably secured to the base 10 to mount the spring to the base and position the spring in a normally vertical position on the base as shown.

The bottom end 18 of the spring may be suitably secured to the base 12 by a suitable adhesive, by being mechanically secured to the base such as by stapling or by being securely but removably secured to the base 12 by being received compressibly in an annular groove 22 formed in the top of the base 12. The annular groove 22 is dimensioned slightly smaller than the expanded diameter of the bottom 22 of the spring 14 whereby upon the bottom helical portion of the spring 14 being rotated in the direction of the helix to reduce the diameter of the bottom portion, the bottom portion is inserted in the annular groove 22 and released whereby the bottom helical portion 18 of the spring 14 expands in the groove thereby wedging the bottom of the spring in the groove and frictionally securing the spring to the base 12.

The base 12 may be of suitable material such as wood or plastic and the helical spring 14 may be of a suitable metal or metal alloy.

As may be best seen from FIG. 1, the entertainment apparatus of the present invention further includes a plurality of travelling means, such as diagrammatically indicated balls 24, which travelling means are mounted slidably on said spring along the helical length thereof between the top and bottom ends thereof and which travelling means are displacable downwardly along the length of the spring upon the spring vibrating. As may be further understood from FIGS. 3 and 4, and in accordance with the further teaching of the present invention, the travelling means may comprise a plurality of balls 24 and **25*a*, respectively, each of which is provided with a passageway 26 and 26*a*, respectively extending therethrough whereby the travelling means are slidably mounted on the spring 14** by the spring extending through such passageways.

Figure 3:
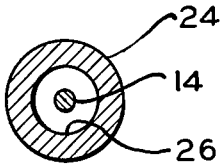
FIGS. 3 and 4 are cross-sectional views of alternate embodiments of the travelling means of the present invention.
Figure 4:
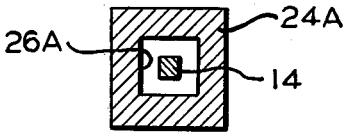
Figure 2:
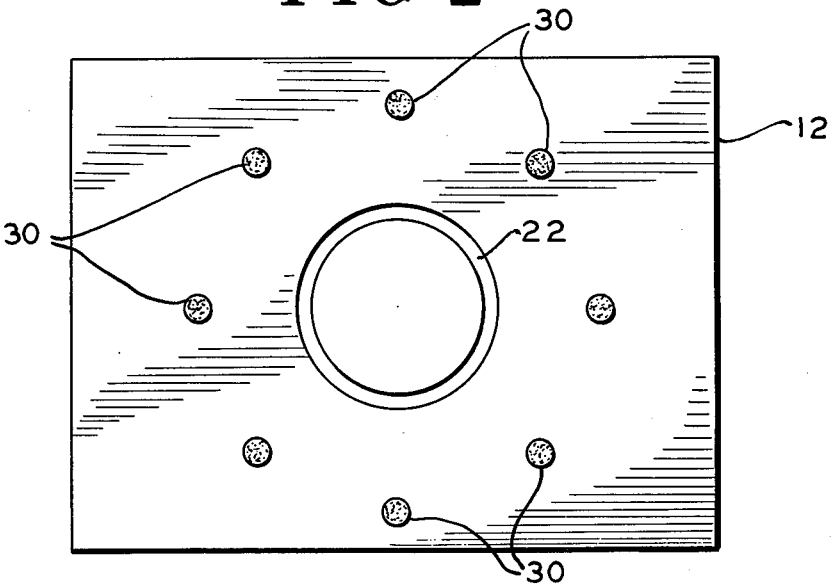
FIG. 2 is a top view of the entertainment apparatus of FIG. 1 with a portion of the apparatus being removed to show certain structures.

As shown in FIG. 3, and in accordance with the teaching of the present invention, the travelling means 24, passageway 26 and spring 14 may be of circular cross-section. Alternately, and in accordance with the teaching of the present invention, the travelling means **24*a*, passageway 26*a*, and spring 14 may be of rectangular cross-section. It will be further understood that the diameter of the passageways 26 and 26*a* and the outer dimension of the spring 14 are dimensioned complementarily such that the spring 14** is received loosely and slidably within the passageways.

In operation or play, the travelling means 24 are first positioned at the top 16 of the spring by being moved slidably along the length of the spring to the top 16. As such, the pitch helical spring 14 decreases proximate to top end 16 to effectively prevent travelling means 24 from being displaced off of spring 24. Then, a player if playing alone, or each player in turn if two or more players are playing, displaces the spring 14 from its normally vertical position and releases the spring allowing the spring to vibrate and return to its normal vertical position. The vibrating spring causes the plurality of travelling means 24 to be displaced downwardly along the length of the spring between the top and bottom ends thereof a certain distance dependent upon the amount of vertical displacement and vibrating of the spring. Then, this is repeated until all of the travelling means 24 are displaced downwardly along the length of the spring and congregate in intimate contact with the bottom end 18 of the spring 14. The amusement and the challenge associated with the operation of the apparatus is thus when spring 14 is displaced and released, the vibration thus caused may cause one or more of travelling means 24 to travel up spring 14 as opposed to displacement downwardly, hence the reason for the decreased pitch of spring 14 proximate to end 16. It will be recognized by those skilled in the art that end 16 could equally as well have a stop to prevent travelling means 24 from becoming displaced from spring 14.

When two of more players are thus playing the entertainment apparatus of the present invention, the player providing the displacement of the spring which finally causes all travelling means to congregate at the bottom of the spring is the winner and a single player playing the game provided by the entertainment apparatus of the present invention is entertained by determining how many or how few displacement of the spring and vibrations thereof are required to congregate all of the travelling means 24 at the bottom of the spring.

It will be further understood in accordance with the teachings of the present invention that the base 12 is suitably dimensioned and weighted so as to maintain the entertainment apparatus 10 oriented as shown in FIG. 1.

In accordance with the further teaching of the present invention, the entertainment apparatus of the present invention may further include a plurality of markers 30 disposed on the top surface of the base 12 around the spring 14 and which markers 30 define directions toward which the spring 14 is displaceable. The markers 30 may be provided on the base 12 by being painted thereon or applied as a decal or indentation or embossment.

In accordance with the further teaching of the present invention, the marker 30 may be chosen arbitrarily by a player or players or the markers 30 may be utilized in conjunction with random selection means such as dice or a rotatable arrow surrounded by a plurality of radially disposed numbers wherein the numbers provided by the possible combinations on the dice or the number determined by the rotatable arrow would correspond with the numbers of the markers 30.

It will be still further understood by those skilled in the entertainment apparatus art that many modifications and variations may be made in the present invention without departing from the spirit and the scope thereof.

What is claimed is:

1. Entertainment apparatus providing a game to be played, comprising:

a base;

a helical spring having a top end and bottom end, said bottom end being secured to said base to mount the spring to the base and to position the spring in a normally vertical position on the base, and said spring defining a helical path between said top end and said bottom end thereof;

a plurality of travelling means, said travelling means mounted slidably on said spring and being displaceable downwardly along the helical length of the spring between said top and said bottom ends thereof upon said spring vibrating;

a plurality of markers disposed on said base around said spring and said markers defining directions toward which said spring is displaceable; and upon said spring being displaced from its normally vertical position towards one of said markers and then being released, said spring vibrating and returning to its normally vertical position and said vibrating spring causing said plurality of travelling means to be displaced downwardly along the length of said spring between said top and bottom ends thereof.

* * * * *